US012704346B2

(12) United States Patent
Bassoli et al.

(10) Patent No.: US 12,704,346 B2
(45) Date of Patent: Aug. 11, 2026

(54) TRAINING SYSTEM

(71) Applicant: FABBRICA D'ARMI PIETRO BERETTA S.P.A., Gardone Val Trompia (IT)

(72) Inventors: Marco Bassoli, Gardone Val Trompia (IT); Giacomo Ziliani, Gardone Val Trompia (IT); Giulio Bonetti, Gardone Val Trompia (IT); Sergio Bonomi, Gardone Val Trompia (IT)

(73) Assignee: FABBRICA D' ARMI PIETRO BERETTA S.P.A., Gardone Val Trompia (IT)

( * ) Notice: Subject to any disclaimer, the term of this patent is extended or adjusted under 35 U.S.C. 154(b) by 234 days.

(21) Appl. No.: 18/714,144

(22) PCT Filed: Oct. 7, 2022

(86) PCT No.: PCT/IB2022/059590

§ 371 (c)(1),
(2) Date: May 29, 2024

(87) PCT Pub. No.: WO2023/118986

PCT Pub. Date: Jun. 29, 2023

(65) Prior Publication Data

US 2025/0035399 A1 Jan. 30, 2025

(30) Foreign Application Priority Data

Dec. 23, 2021 (IT) ..... 102021000032480

(51) Int. Cl.
*F41A 33/06* (2006.01)

(52) U.S. Cl.
CPC ..... *F41A 33/06* (2013.01)

(58) Field of Classification Search
CPC ..... F41A 33/06
See application file for complete search history.

(56) References Cited

U.S. PATENT DOCUMENTS 9,212,861 B2 * 12/2015 Panak ..... F41G 3/00
9,759,521 B2 * 9/2017 Carriere ..... F41G 3/2616
(Continued)

FOREIGN PATENT DOCUMENTS

EP 3913314 A1 11/2021
JP 2004239528 A 8/2004

OTHER PUBLICATIONS

International Search Report for corresponding application PCT/IB2022/059590 filed Oct. 7, 2022; Mail date Jan. 31, 2023.
(Continued)

*Primary Examiner* — Malina D. Blaise
(74) *Attorney, Agent, or Firm* — Ferguson Case Orr Paterson

(57) ABSTRACT

A training system for using a firearm is provided. The training system has a simulacrum firearm having a trigger assembly, electro-stimulators engaging a user's body for producing an electrical stimulation, shot detectors for detecting an actuation of the trigger assembly, a grip detection unit for detecting modes of gripping the simulacrum firearm by the user, and a command and control unit operatively connected to the simulacrum firearm and to the electro-stimulators to control the electro-stimulators on actuation upon a detection of an event of a fired a shot by the shot detectors The command and control unit commands intensity, duration, timing and type of electrical stimulation, namely electric current, emitted by the electro-stimulators as a function of a detection performed by the grip detection unit.

22 Claims, 4 Drawing Sheets

(56) References Cited

U.S. PATENT DOCUMENTS

| | | | | |
|---|---|---|---|---|
| 11,132,915 | B1 | 9/2021 | Mciver et al. | |
| 12,005,346 | B2 * | 6/2024 | Monti | A63F 13/245 |
| 2010/0173686 | A1 * | 7/2010 | Grant | F41A 33/06 463/2 |
| 2010/0227298 | A1 * | 9/2010 | Charles | F41A 33/00 434/21 |
| 2013/0022944 | A1 * | 1/2013 | Slayton | A63F 13/245 434/16 |
| 2015/0204109 | A1 * | 7/2015 | Ergenbright | G05B 13/00 340/541 |
| 2019/0129384 | A1 * | 5/2019 | Cherney | G02B 27/01 |
| 2019/0213901 | A1 * | 7/2019 | Kur | G06F 3/013 |
| 2020/0341542 | A1 * | 10/2020 | Kur | G06F 3/011 |
| 2021/0341257 | A1 * | 11/2021 | Mock | F41G 1/35 |
| 2021/0381806 | A1 * | 12/2021 | Colachis | A61N 1/0456 |
| 2022/0214127 | A1 * | 7/2022 | French | F41A 19/17 |
| 2022/0249947 | A1 * | 8/2022 | Monti | A63F 13/245 |
| 2022/0252376 | A1 * | 8/2022 | De Sarran | F42B 19/24 |
| 2023/0400277 | A1 * | 12/2023 | Monti | F41A 33/06 |
| 2025/0367066 | A1 * | 12/2025 | Curley | A61H 15/0085 |

OTHER PUBLICATIONS

International Search Report for corresponding application PCT/IB2022/059593 filed Oct. 7, 2022; Mail date Jan. 31, 2023.
International Search Report for International Patent Application No. PCT/IB2022/061034, mailed Feb. 8, 2023.
Written Opinion for corresponding application PCT/IB2022/059590 filed Oct. 7, 2022; Mail date Jan. 31, 2023.
Written Opinion for corresponding application PCT/IB2022/059593 filed Oct. 7, 2022; Mail date Jan. 31, 2023.
Written Opinion for International Patent Application No. PCT/IB2022/061034, mailed Feb. 8, 2023.

* cited by examiner

TRAINING SYSTEM

CROSS-REFERENCE TO RELATED APPLICATIONS

This application is a National Phase Application of PCT International Application PCT/IB2022/059590, having an International Filing Date of Oct. 7, 2022 which claims priority to Italian Application No. 102021000032480 filed Dec. 23, 2021, each of which is hereby incorporated by reference in its entirety.

FIELD OF THE INVENTION

The present invention relates to a training system for using a firearm. Furthermore, the present invention relates to a training method performed by means of said training system.

In particular, but not in a limiting manner, the present invention relates to the defense field.

BACKGROUND OF THE INVENTION

It is clearly important to be as trained as possible in the use of a firearm. In fact, the use of a firearm contextualizes a situation of potential danger both for those who use it and for those in the vicinity of the user. More training corresponds to a more limited and contained potential danger. Only practice and constant training give the user of the firearm the experience to exploit it effectively and use it safely.

Therefore, it is known in the prior art to find solutions to train, or coach, people and/or law enforcement and/or military forces in the use of firearms.

The more the practice, or the training, takes place in conditions similar to real conditions, the greater the preparation and the benefit gained by the user and those around him/her, limiting as much as possible a potentially dangerous situation.

In the prior art, a first type of training systems is known in which real firearms are usable in a special training area or park.

This first type of training system allows an experience physically very similar to the real one, but requires a large training area or park, and above all the use of real firearms contextualizes dangerous situations which do not therefore allow training to be carried out in groups.

Real firearms are used to perform group training, but loaded with blanks. Clearly, the drawback relating to the need to have a large training area or park remains unchanged.

In the prior art, a second type of training systems is also known in which a real firearm is used, loaded with light bullets, often staining bullets. Again, the drawback relating to the need to have a large training area or park remains unchanged, to which is added how the specific experience of using the firearm, which is not adherent to the real one.

To overcome the aforementioned drawbacks, training system solutions have therefore been created in which the experience is performed using simulacrum firearms, that is firearms that are not real. In addition, solutions are known in which the training area is virtualized, for example on screens.

This type of training system does not require a large training area or park, and is in fact also performable in a closed environment; in addition, the use of simulacrum firearms contextualizes greater safety. However, the experience is not as physically convincing as the real one: therefore an experience that fails to give the user physical sensations and a sense of fatigue similar or comparable to the real one fails to achieve the intended purpose.

Furthermore, in the prior art there are also mixed solutions, in which the virtual experience is combined with the real one, exploiting for example augmented reality viewers. However, even these solutions have specific drawbacks and it has been found that they in turn fail to achieve the purpose for which they are intended, that is, to perform an effective training in conditions as similar as possible to those of a real situation.

The need is therefore strongly felt to provide and/or orientation and/or configuration of a training system which solves the aforementioned drawbacks by integrating the advantageous aspects of each of the known solutions, but above all by being safe and contextualizing a training situation with conditions that are as real as possible, causing the user a physical stress substantially similar to that which he/she would suffer during a real action.

SUMMARY OF THE INVENTION

The object of the present invention is to provide a training system which solves the above need.

This object is achieved by the training system and the method of training by the training system described and claimed herein. Preferred variant embodiments involving further advantageous aspects are also described.

BRIEF DESCRIPTION OF THE FIGURES

Further features and advantages of the invention will become clear from the description given below of its preferred embodiments as non-limiting examples, with reference to the attached figures, wherein.

DETAILED DESCRIPTION

Figure 1A:
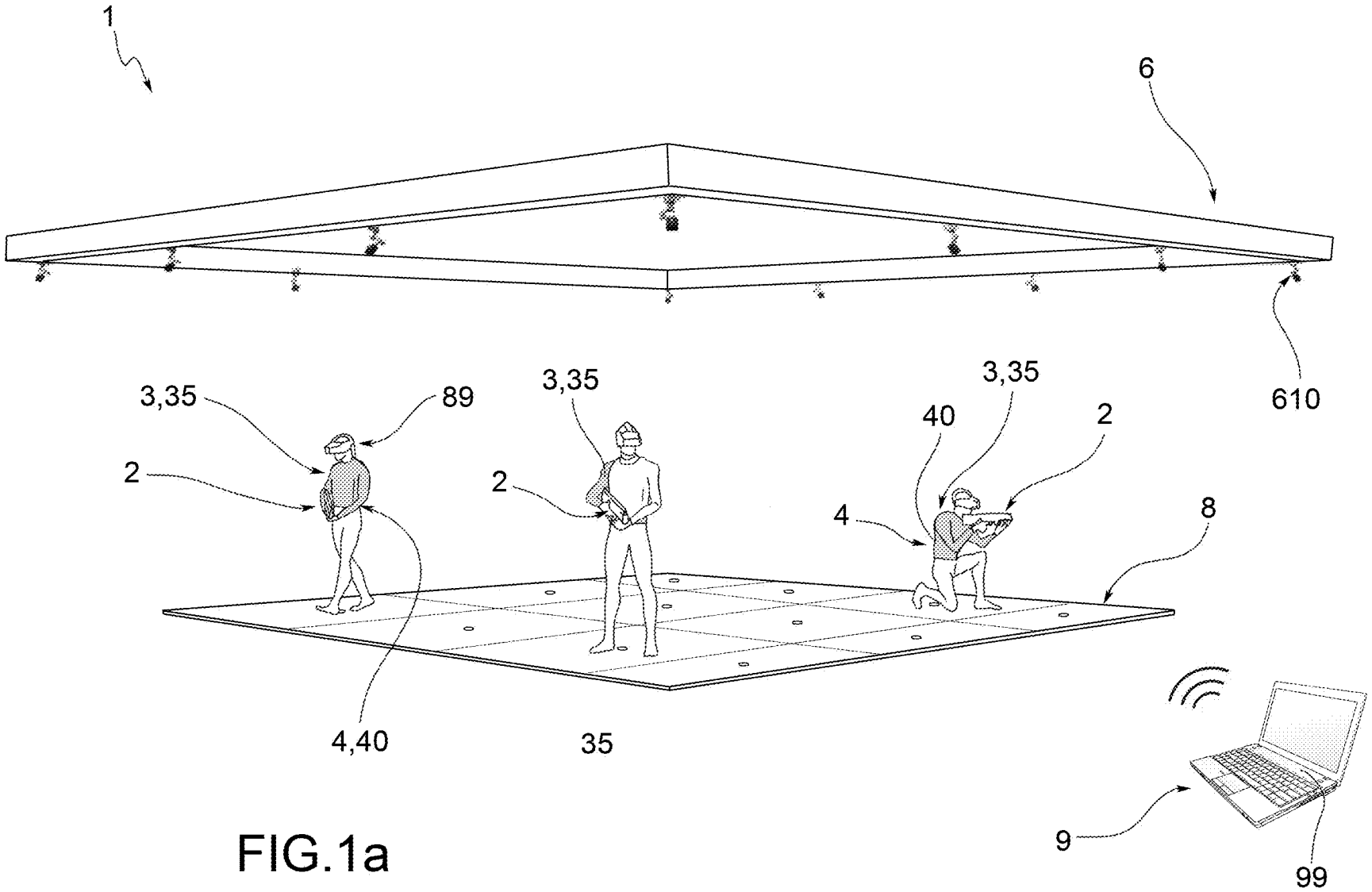
FIGS. 1*a* and 1*b* show two schematic views related to training systems according to the present invention.
Figure 1B:
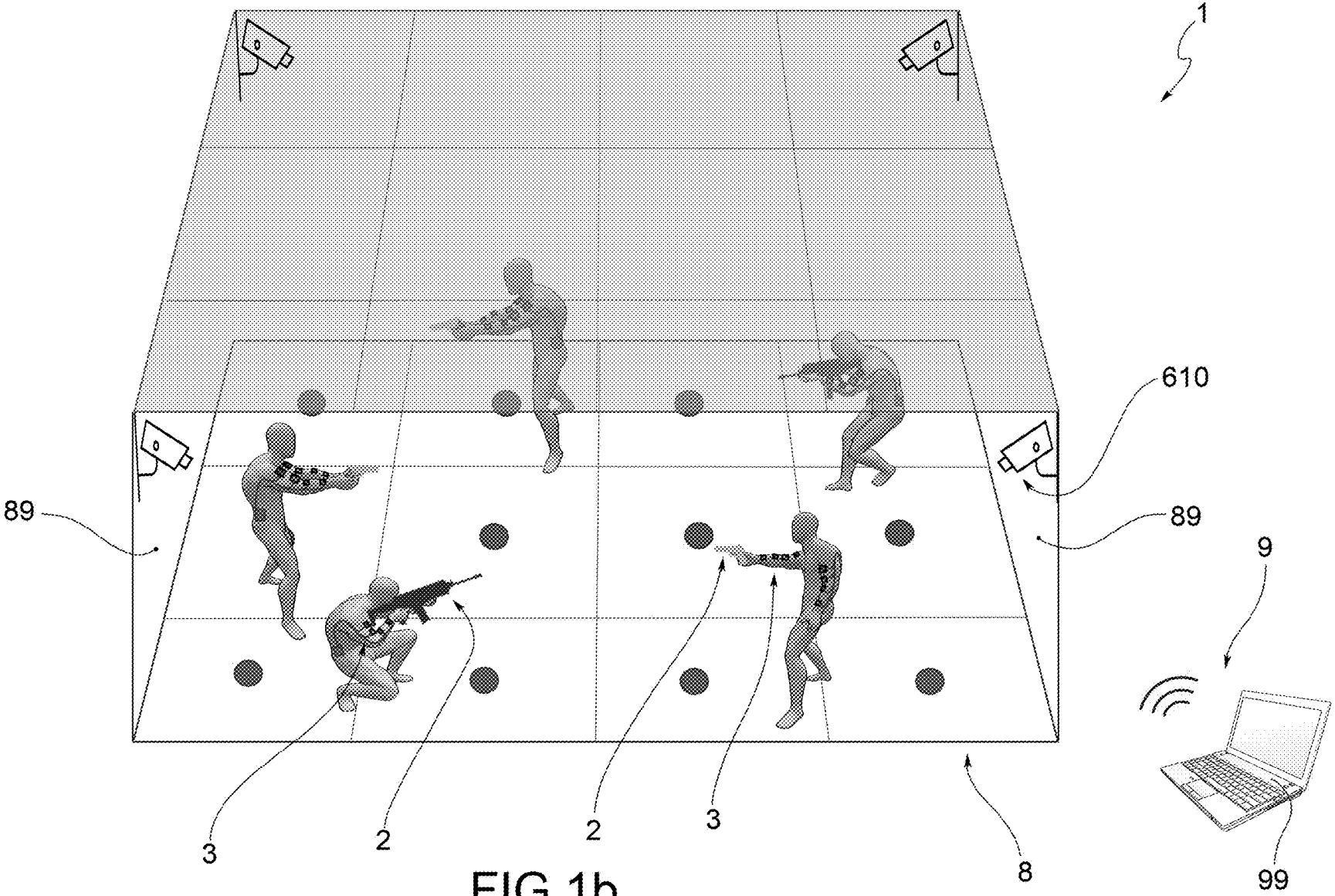
Figures 2A, 2B, 2C:
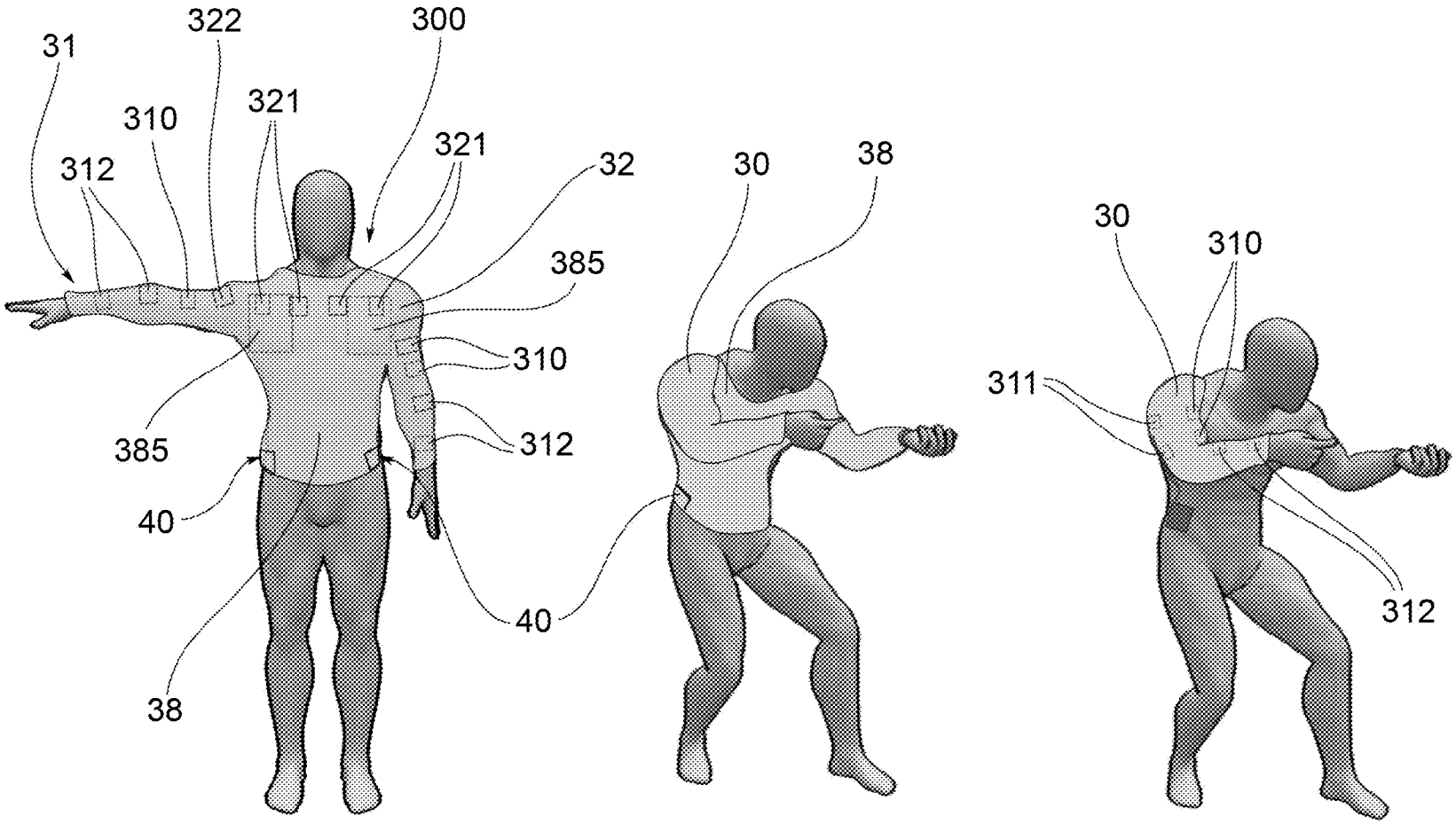
FIGS. 2*a*, 2*b* and 2*c* show electro-stimulator means comprised in the training system according to the present invention, respectively.
Figure 3A:
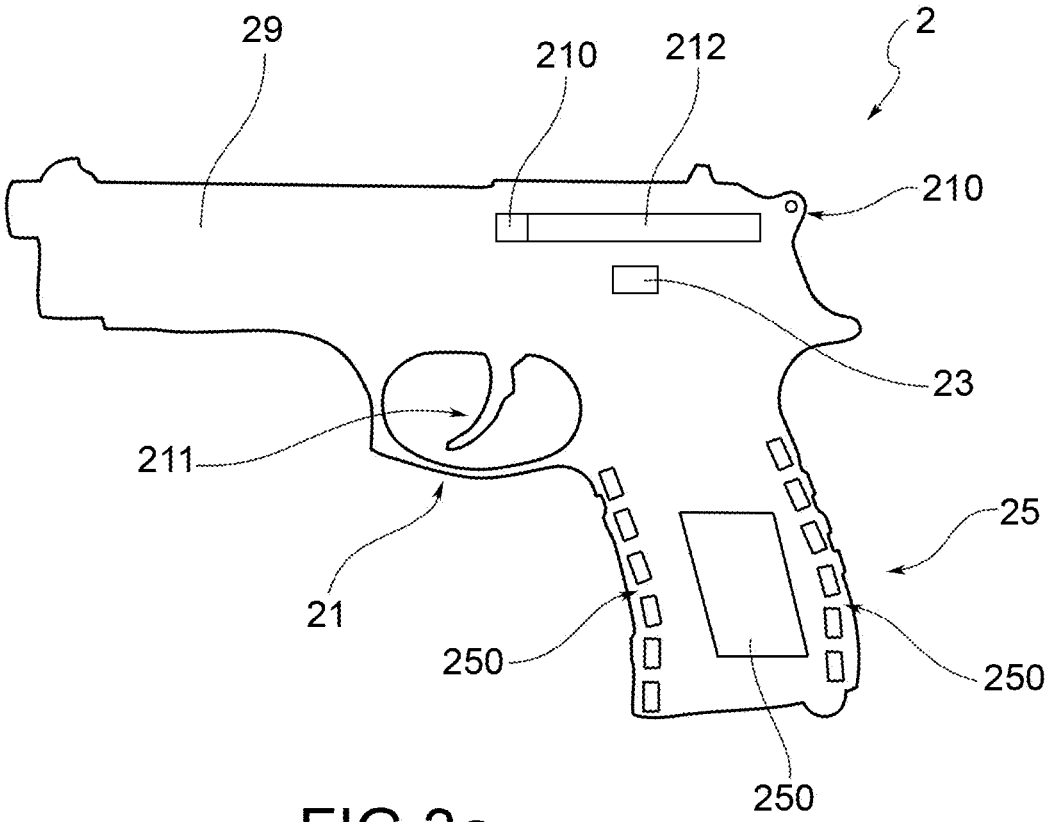
FIGS. 3*a* and 3*b* show two schematic views of two simulacrum firearms comprised in the training system according to the present invention.
Figure 3B:
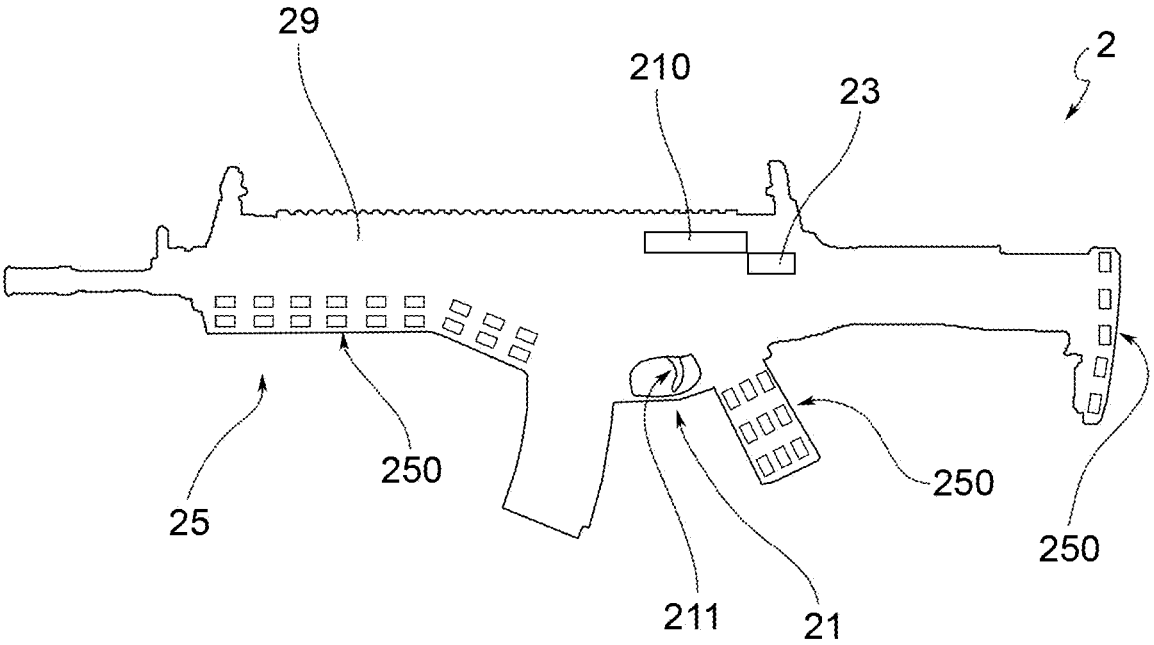

With reference to the accompanying figures, reference number 1 indicates a training system 1 for using a firearm according to the present invention.

The training system 1 that is the object of the present invention comprises a simulacrum firearm 2. Simulacrum firearm means a firearm that is not suitable for performing a real shooting action, projecting a bullet, but which simulates the features of a real firearm.

For example, the shape, dimensions, measurements and weight of the simulacrum firearm 2 are substantially identical to those of a specific real firearm.

According to a preferred embodiment, the simulacrum firearm 2 is a replica of a predefined real firearm.

According to a further preferred embodiment, the simulacrum firearm 2 is an assemblable product or to which certain pieces or components are assemblable in such a way as to assemble the firearm in a desired configuration, for example with a shape and weight similar to those of a real firearm.

Preferably, the simulacrum firearm 2 is a gun or a rifle or a machine gun etc.

According to a preferred embodiment, the simulacrum firearm 2 comprises a firearm body 29 comprising a plurality of mountable body portions for constructing the firearm body. Said portions are for example suitable for simulating the weight and/or the balance of the weights of the firearm, or more generally the shape and/or the dimensions.

Preferably, the simulacrum firearm 2 is configurable in a gun or a rifle or a machine gun in function of the mounting modes of the firearm body 29.

The simulacrum firearm 2 further comprises a trigger assembly 21 operable by the user to perform, in a simulated manner, the shooting action.

According to a preferred embodiment, the trigger assembly 21 comprises shot detection means 210 suitable for detecting the actuation of the trigger assembly 21.

According to a preferred embodiment, the trigger assembly 21 is operable by the user comprising a trigger member 211 and an actuation member 212, preferably a hammer or firing pin. Preferably, the actuation of the trigger member 211 results in an actuation of the actuation member 212 and said shot detection means 210 detect the actuation of the actuation member 212.

According to a preferred embodiment of the present invention, the simulacrum firearm 2 further comprises a grip detection unit 25 suitable for detecting the modes of gripping the simulacrum firearm 2 by the user.

According to a preferred embodiment, the grip detection unit 25 comprises grip detection elements 250 suitable for detecting the position and/or orientation and/or configuration of the firearm-user contact.

According to a preferred embodiment, the simulacrum firearm 2 is a gun and the grip detection elements 250 are positioned on the grip and are suitable for detecting the presence of a single hand, identifying a right-handed or a left-handed grip or both hands on the grip, so as to distinguish a single-handed grip from a two-handed grip by the user.

According to a further preferred embodiment, the simulacrum firearm 2 is a rifle or a machine gun and the grip detection elements 250 are positioned on the grip and are suitable for detecting the presence of one hand on the grip, identifying a right-handed or a left-handed grip on the grip, and they are positioned on the firearm body so as to detect the presence of the second hand on the grip.

According to a further preferred embodiment, the simulacrum firearm 2 comprises a butt and the grip detection elements 250 are positioned on said butt, suitable for detecting the engagement with the user's chest.

According to a preferred embodiment, the grip detection elements 250 comprise piezoresistive sensors, preferably a matrix of piezoresistive sensors.

According to a preferred embodiment, the grip detection elements 250 comprise capacitive sensors, preferably a matrix of capacitive sensors.

According to a preferred embodiment, the grip detection elements 250 comprise mechanical sensors, preferably a matrix of mechanical sensors; mechanical sensor preferably means a mechanical switch.

According to a preferred embodiment, the grip detection elements 250 comprise resistive sensors, preferably a matrix of resistive sensors.

According to a preferred embodiment, the grip detection elements 250 comprise thermal sensors, preferably a matrix of thermal sensors.

According to a preferred embodiment, the grip detection elements 250 comprise optical sensors, preferably a matrix of optical sensors.

According to further preferred embodiments, the grip detection elements 250 comprise more than one sensor among those described above.

According to a preferred embodiment, the grip detection unit 25 also detects the force, preferably the pressure, of engagement exerted by the user on the firearm.

According a preferred embodiment, the to simulacrum firearm 2 comprises firearm spatial detection means 23 by means of which the position and/or orientation and/or configuration in space of the simulacrum firearm 2 is detectable, e.g. a movement thereof, or a position and/or orientation and/or tilted configuration of the firearm with respect to a fixed system of reference. Preferably, said fixed system of reference takes the ground plane as a reference.

According to a preferred embodiment, the firearm spatial detection means 23 are suitable for detecting an acceleration undergone by the firearm, for example when shooting.

According to the present invention, the training system 1 comprises electro-stimulator means 3 engaging the user's body, which means are suitable for producing an electrical stimulation, that is an electric current, in the user's musculature.

According to a preferred embodiment, the electro-stimulator means 3 comprise a group of electrodes, that is a plurality of electrodes suitable for engaging the user's body to apply an electric current on command.

According to a preferred embodiment, the group of electrodes is suitable for engaging the user's arm.

According to a preferred embodiment, the electro-stimulator means 3 comprise an arm electrode element group 31 comprising biceps electrodes 310, triceps electrodes 311 and brachioradialis electrodes 312.

According to a further embodiment, the electro-stimulator means 3 comprise a right arm electrode element group and a left arm electrode element group, each group comprising biceps electrodes 310, triceps electrodes 311 and brachioradialis electrodes 312.

According to a preferred embodiment, the electro-stimulator means 3 comprise a wearable arm device 30, e.g., a sleeve, housing the arm electrode element group 31.

According to a further preferred embodiment, the group of electrodes is suitable for engaging the user's torso.

According to a preferred embodiment, the electro-stimulator means 3 comprise a torso electrode element group 32 comprising chest electrodes 321 and shoulder electrodes 322.

According to a preferred embodiment, the electro-stimulator means 3 comprise a wearable torso device 38, e.g., a waistcoat, housing the torso electrode element group 32.

According to a preferred embodiment, the wearable torso device 38 further comprises a butt detection unit 385 suitable for detecting the engagement of the butt of the simulacrum firearm 2 with the user's chest.

In addition, preferred embodiments are present, comprising both the arm electrode element group 31 and the torso electrode element group 32.

According to a preferred embodiment, the system comprises a wearable device 300 comprising both the wearable arm devices 30 and the wearable torso device 38.

According to a preferred embodiment, the aforementioned wearable devices comprise an elasticized fabric in such a way as to adhere to the user's body and therefore keep the electrode elements in direct contact with the user's body.

According to a preferred embodiment, the electrode groups comprise electrode elements suitable for engaging pairs of muscles, that is for engaging agonist and antagonist muscles. For the purposes of the present invention, with the object to give real physical feedback during a training session, the solicitation of the one and the other is of particular importance. Preferably, for example, both the biceps and the triceps or both the chest and the shoulder are stressed. Preferably, as described below, the stress on certain muscles occurs in distinct steps.

According to a further preferred embodiment of the present invention, the training system 1 comprises a grip detection unit 35 suitable for detecting the modes of gripping the simulacrum firearm 2 by the user (similarly to the modes described above), using the electro-stimulator means 3.

In particular, according to a preferred embodiment, the grip detection unit 35 is suitable for detecting the electrical resistance between the simulacrum firearm 2 and the electro-stimulator means 3.

In particular, according a preferred to embodiment, the grip detection unit 35 is suitable for detecting the electrical capacitance between the simulacrum firearm 2 and the electro-stimulator means 3.

In this way, depending on which electrodes have a different electrical resistance and/or a different electrical capacitance, the grip detection unit 35 identifies a right-handed grip from a left-handed and/or from a two-handed grip.

According to a preferred embodiment, the training system 1 further comprises body state detection means 4 comprising devices for detecting the position and/or orientation and/or spatial configuration of the user 40, e.g. a position and/or orientation and/or erect configuration thereof or a position and/or orientation and/or extended configuration thereof.

Preferably, said body state detection means 4 are in turn wearable by the user in such a way as to be directly influenced by the positioning of the user.

According to a preferred embodiment, the training system 1 comprises a training region 8 in which the user performs said training.

According to a preferred embodiment, said training region 8 has contained and limited dimensions, for example being in a room or in an enclosed environment. According to a preferred embodiment, the training system 1 comprises a viewer screen 89 projecting a virtual training reality. Preferably, said screen 89 is at the perimeter of the training region 8 on a monitor, or on more than one monitor. Preferably, said screen 89 is worn by the user him/herself, for example a helmet or a viewer.

According to a preferred embodiment, said training region 8 has important dimensions, for example being an open environment. According to a preferred embodiment, the training system 1 comprises an augmented reality viewer worn by the user.

According to a preferred embodiment, the movements and actuations of the simulacrum firearm 2 are visible on said screens and influence the virtualized situations projected therein, showing for example a hit target or a missed target.

According to a preferred embodiment, the training region further comprises user detection assemblies 6 suitable for detecting the user inhabiting and living the training region 8 and for detecting the status thereof.

For example, such user detection assemblies 6 are suitable for detecting the position and/or orientation and/or configuration and orientation of the user and the firearm.

For example, such user detection assemblies 6 are suitable for also comprising shot detection means 610 and therefore are suitable for detecting the user's pressure on the trigger 21.

According to the present invention, the training system 1 also comprises a command and control unit 9.

The command and control unit 9 is operatively connected to the simulacrum firearm 2 and to the electro-stimulator means 3 in such a way as to command the latter on actuation to the detection of the shot event fired by the shot detection means 210, 610.

In other words, the user, in carrying out a training session in the training system 1 using the simulacrum firearm 2 and wearing the electro-stimulator means 3, is subjected to electro-stimulation in his/her own musculature to the correspondence of a determined shooting action. At the correspondence of a training action that involves multiple shooting situations leads to greater stimulation of the muscles and therefore to greater physical fatigue.

In other words, the training system 1 effectively simulates the stress action on the user's musculature by simulating the effect of the shot and the recoil of a real firearm.

According to a preferred embodiment, the command and control unit 9 commands the intensity, duration, timing and type of electrical stimulation emitted by the electro-stimulator means 3 as a function of the detection carried out by the grip detection unit 25, 35.

In other words, the command and control unit 9 activates the electrodes as a function of the detected mode of gripping.

Preferably, the command and control unit 9 activates the electrodes as a function of the fact that the grip is right-handed or left-handed, with one hand or with two hands.

Preferably, the command and control unit 9 activates the electrodes as a function of the type of simulacrum firearm 2.

Preferably, the command and control unit 9 activates the electrodes as a function of the intensity of the user's grip on the simulacrum firearm 2.

According to a preferred embodiment, the command and control unit 9 activates the electrodes as a function of what is detected by the firearm spatial detection means 23.

For example, upon detecting greater accelerations on the firearm, that is more sudden movements, the command and control unit 9 activates the electrodes more.

For example, upon detection of greater accelerations on the firearm, that is of a plurality of shots fired, the command and control unit 9 activates the electrodes more.

According to a preferred embodiment, the command and control unit 9 activates the electrodes as a function of the type of simulacrum firearm 2.

According to a preferred embodiment, the command and control unit 9 activates the electrodes as a function of the type and number of body portions, and therefore as a function of the type of real firearm simulated by the simulacrum firearm 2.

According to a preferred embodiment, the command and control unit 9 activates the electrodes as a function of what is detected by the body state detection means 4.

According to a preferred embodiment, the command and control unit 9 is operatively connected to the virtual training reality and is suitable for varying the action of the electrodes on the basis thereof.

According to a preferred embodiment, the command and control unit 9 is configurable in a plurality of shooting operating modes, wherein a predefined intensity, duration, and type of electrical stimulation corresponds to each operating mode.

According to a preferred embodiment, the command and control unit 9 comprises a memory 99 in which a plurality of data are stored, in which specific data correspond to each shooting operating mode, and therefore a specific electrical action.

Preferably, said operating modes each correspond to a different type of firearm simulated by the simulacrum firearm 2, for example a gun or a machine gun or a rifle.

Preferably, said operating modes each correspond to a different type of caliber simulated by the simulacrum firearm 2.

Furthermore, according to a preferred embodiment, the command and control unit 9 is configurable in a single shooting operating mode or in a burst shooting operating mode.

Preferably, to the detection of the shot event by the shot detection means 210 corresponds a single shot, and therefore a single actuation of the electro-stimulator means 3, or a burst shot, and therefore a multiple actuation of the electro-stimulator means 3.

According to a preferred embodiment, an electrical pulse usually has an amplitude lower than 50 mA and a duration of from 0.150 to 0.250 ms.

According to a preferred embodiment, a fired shot event is simulated with a close current of pulses, said pulses have a frequency of between 90 and 130 Hz.

The number of pulses, and their frequency, varies in function of the desired reaction in the muscle.

In the simulation of small calibers, for example the .22 caliber, the number of pulses is about 2-3 and these pulses are performed with a frequency of between 90 and 130 Hz.

In the simulation of larger calibers, said pulse discharges are performed with a greater number of pulses, for example 10-12, and by increasing the amplitude of the peaks.

Similarly, even a firm grip (in which the recoil is less) is simulated with a limited number of pulses, for example about 3-4, with a frequency of between 90 and 130 Hz.

Even in the simulation of shots with a loose grip of the firearm (which therefore has more recoil), the pulse discharges are performed with a greater number of pulses than those mentioned above.

Note that to a greater number of pulses corresponds a greater number of activated muscle bundles.

According to a preferred embodiment, the simulation of an automatic firearm suitable for reproducing a series of shots involves the muscular stimulation performed by reproducing a sequence of a multiplicity of close discharges with a cadence for example of 10 Hz or otherwise compatible with the cadence of the automatic shooting of the firearm.

According to a preferred embodiment, the command and control unit 9 is suitable for collecting in real time all the detections performed and is suitable for modifying the action of the electrodes during the training session itself.

According to a preferred embodiment, by means of the aforementioned collection in real time, the command and control unit 9 is suitable for calibrating the action of the electrodes over time, obtaining a simulation of the recoil action of the firearm as real as possible.

According to further preferred embodiments, the training system 1 is usable simultaneously by a plurality of users. Each user uses a simulacrum firearm 2 and wears electro-stimulator means 3.

According to such preferred embodiment, the command and control unit 9 is also suitable for commanding the actuation of the electro-stimulator means 3 of a user with the aim of simulating the shot performed by the other user.

According to such preferred embodiment, the command and control unit 9 commands the intensity, the duration, the timing and type of electrical stimulation, that is the type of electric current, in such a way that it is greater than the simulation of the recoil of the firearm.

According to such preferred embodiment, depending on the area to be simulated as being hit, the command and control unit 9 commands one or more electrodes, for example those engaging a forearm, keeping the others switched off.

Preferably, in this manner, the training experience for the user is thus even more complete, with the latter, in fact, also experiencing the sensations of stress and fear resulting from the risk of being hit.

It is an object of the present invention also a method for training to use a firearm, by means of a training system 1 having the features described above.

According to the present invention, the training method comprises the steps of:

- detecting the shot event fired by the shot detection means 210, 610;
- detecting the grip of the firearm by the user by means of the grip detection unit 25, 35;
- actuating the electro-stimulator means 3 and producing an electrical stimulation in the user's musculature as a function of the detection conducted by the grip detection unit 25, 35.

Each feature, configuration, and action performed in the training system 1, and by the components that compose it, according to what has been described above, is also detectable as a step of the training method performable by means of the training system 1.

Innovatively, the training system largely meets the object of the present invention, thus overcoming the typical drawbacks of the prior art.

Advantageously, in fact, the training system is an extremely versatile solution which simulates a situation very similar to the real one, thus going to perform an effective training for the users.

Advantageously, while using a simulacrum firearm, the user has haptic feedback to the correspondence of a shot event.

Advantageously, while using a simulacrum firearm, the user is subjected to involuntary movements similar to real ones, making the aiming operation difficult following one or more shots.

Advantageously, while using a simulacrum firearm, during a training session and thereafter, the user is subject to a state of fatigue.

Advantageously, the electrical action is performed on both agonist and antagonist muscles.

Advantageously, the electrical action is also variable in function of further conditions, such as for example the position and/or orientation and/or spatial configuration of the simulacrum firearm, for example the inclination thereof, and/or the position and/or orientation and/or spatial configuration of the user, e.g. a position and/or orientation and/or erect configuration thereof with respect to a position and/or orientation and/or extended configuration.

Advantageously, the training system recognizes and manages situations that are different from each other, for example a firm grip from a softer grip, a single-handed grip from a two-handed grip, commanding in actuation different electrodes.

Advantageously, the training system is calibratable in function of the user's features.

Advantageously, the training system is calibratable in function of the features of the simulacrum firearm.

Advantageously, the training system varies the electrical action as the detected conditions vary: for example, during a session, training a rather than simulation of machine gun fire, the user will decrease the gripping action or will have difficulty in aiming, for example by holding the simulacrum firearm in a tilted position and/or orientation and/or configuration, and will therefore be subjected to higher electric currents.

Advantageously, the simulacrum firearm is assemblable in function of the needs. Advantageously, the simulacrum firearm is therefore extremely versatile and usable in a plurality of different situations.

Advantageously, the training region 8 may have small dimensions and may also be performed in closed places.

Advantageously, the training is virtualizable.

Advantageously, the training is performable in groups, presenting real people in the same training region or presenting people in a virtual reality using, remotely, different training systems.

It is clear that, in order to meet contingent needs, a person skilled in the art may make changes to the training system described above, all contained within the scope of protection defined by the following claims.

The invention claimed is:

1. A training system for using a firearm, comprising:

a simulacrum firearm comprising a trigger assembly operable by a user to perform a shooting action;

electro-stimulator means engaging the user's body and suitable for producing an electrical stimulation in the user's musculature;

shot detection means suitable for detecting an actuation of the trigger assembly;

a grip detection unit suitable for detecting modes of gripping the simulacrum firearm by the user; and a command and control unit operatively connected to the simulacrum firearm and to the electro-stimulator means to control the electro-stimulator means on actuation upon a detection of an event of a fired shot by the shot detection means, wherein the command and control unit controls an intensity, a duration, a timing and a type of electrical stimulation, namely electric current, emitted by the electro-stimulator means as a function of a detection conducted by the grip detection unit.

2. The training system of claim 1, wherein the grip detection unit comprises grip detection elements suitable for detecting at least one of position, orientation, or configuration of a firearm-user contact.

3. The training system of claim 2, wherein the simulacrum firearm is a gun and the grip detection elements are positioned on a grip and are suitable for detecting presence of a single hand, identifying a right-handed or a left-handed grip, or of both hands on the grip, so as to distinguish a single-handed grip from a two-handed grip by the user.

4. The training system of claim 2, wherein the simulacrum firearm is a rifle or a machine gun and the grip detection elements are positioned on a grip and are suitable for detecting presence of one hand on the grip, identifying a right-handed or a left-handed grip on the grip, and wherein the grip detection elements are positioned on a firearm body to detect presence of a second hand on the grip.

5. The training system of claim 2, wherein the simulacrum firearm comprises a butt and the grip detection elements are positioned on said butt, suitable for detecting an engagement of the butt with the user's chest.

6. The training system of claim 2, wherein the grip detection elements comprise sensors, preferably a matrix of piezoresistive or capacitive or mechanical or thermal or optical sensors.

7. The training system of claim 1, wherein the grip detection unit also detects a force, of engagement exerted by the user on the simulacrum firearm.

8. The training system of claim 1, wherein the grip detection unit detects the modes of gripping the simulacrum firearm by the user, detecting electrical resistance and/or electrical capacity between the simulacrum firearm and the electro-stimulator means.

9. The training system of claim 1, wherein the trigger assembly comprises a trigger member and an actuation member, wherein an actuation of the trigger member results in an actuation of the actuation member, and wherein the simulacrum firearm comprises the shot detection means, which are operatively connected to the actuation member to detect the actuation of the actuation member.

10. The training system of claim 1, wherein the simulacrum firearm comprises a firearm body comprising a plurality of mountable body portions for constructing the firearm body, and wherein the command and control unit controls an actuation of the electro-stimulator means and the intensity, the duration, the timing and the type of electrical stimulation, namely electric current, emitted by the electro-stimulator means as a function of the type of the plurality of mountable body portions.

11. The training system of claim 1, wherein the simulacrum firearm comprises firearm spatial detection means by means of which a position and/or orientation and/or configuration of the simulacrum firearm in the space, or a position and/or orientation and/or configuration, which is tilted, of the simulacrum firearm with respect to a fixed system of reference is detectable, and wherein the command and control unit controls an actuation of the electro-stimulator means and the intensity, the duration, the timing and the type of electrical stimulation, namely electric current, emitted by the electro-stimulator means as a function of what is detected by the firearm spatial detection means.

12. The training system of claim 1, wherein the electro-stimulator means comprise an arm electrode element group comprising biceps electrodes, triceps electrodes and brachioradialis electrodes.

13. The training system of claim 12, wherein the simulacrum firearm is a gun and the grip detection elements are positioned on a grip and are suitable for detecting presence of a single hand, identifying a right-handed or a left-handed grip, or of both hands on the grip, so as to distinguish a single-handed grip from a two-handed grip by the user, and wherein the electro-stimulator means comprise a right arm electrode element group and a left arm electrode element group, each group comprising biceps electrodes, triceps electrodes and brachioradialis electrodes.

14. The training system of claim 12, wherein the electro-stimulator means comprise a wearable arm device, optionally the wearable arm device being a sleeve, housing the arm electrode element group.

15. The training system of claim 1, wherein the electro-stimulator means comprise a torso electrode element group, comprising chest electrodes and shoulder electrodes.

16. The training system of claim 15, wherein the electro-stimulator means comprise a wearable torso device, optionally the wearable torso device being a waistcoat, housing the torso electrode element group.

17. The training system of claim 16, wherein the simulacrum firearm comprises a butt and the grip detection elements are positioned on said butt, suitable for detecting an engagement of the butt with the user's chest, and wherein the wearable torso device further comprises a butt detection unit suitable for detecting the engagement of the butt of the simulacrum firearm with the user's chest.

18. The training system of claim 1, further comprising body state detection means comprising devices for detecting the user's position and/or orientation and/or spatial configuration, optionally the user's position and/or orientation and/or spatial configuration being a position and/or orientation and/or configuration that is erect, or a position and/or orientation and/or configuration that is extended, and wherein the command and control unit controls the intensity, the duration, the timing and the type of electrical stimulation, namely electric current, emitted by the electro-stimulator means as a function of the detection conducted by the body state detection means.

19. The training system of claim 1, wherein the command and control unit is configurable in a plurality of shooting operating modes, wherein a predefined intensity, duration, timing and type of electrical stimulation, namely electric current, optionally as a function of a calibration of the firearm to be simulated, corresponds to each shooting operating mode.

20. The training system of claim 19, wherein the command and control unit is configurable in a single shooting operating mode or in a sequence shooting operating mode, wherein, a single shot, and therefore a single actuation of the electro-stimulator means, or a sequence of shots, and therefore, a multiple actuation of the electro-stimulator means corresponds to the detection of the event of the fired shot by the shot detection means, respectively.

21. The training system of claim 1, further comprising a training region comprising a viewer screen projecting a virtual training reality, wherein the command and control unit is operatively connected to the viewer screen, and wherein use and actuation of the simulacrum firearm is projected into the virtual training reality.

22. A method for training to use a firearm by a training system comprising:

a simulacrum firearm comprising a trigger assembly operable by a user to perform a shooting action;

electro-stimulator means engaging the user's body and suitable for producing an electrical stimulation in the user's musculature;

shot detection means suitable for detecting an actuation of the trigger assembly;

a grip detection unit suitable for detecting modes of gripping the simulacrum firearm by the user; and a command and control unit operatively connected to the simulacrum firearm and to the electro-stimulator means to control the electro-stimulator means on actuation upon a detection of an event of a fired shot by the shot detection means, wherein the command and control unit controls an intensity, a duration, a timing and a type of electrical stimulation, namely electric current, emitted by the electro-stimulator means as a function of a detection conducted by the grip detection unit, the method comprising:

detecting the event of the fired shot by the shot detection means;

detecting a grip of the simulacrum firearm by the user by the grip detection unit; and actuating the electro-stimulator means and producing an electrical stimulation in the user's musculature as a function of the detection conducted by the grip detection unit.

* * * * *